United States Patent [19]

Mosholder

[11] Patent Number: 4,553,826

[45] Date of Patent: Nov. 19, 1985

[54] DEVICE FOR PRESSURE FUSING IMAGES ONTO PAPER IN ELECTROSTATIC COPIERS

[75] Inventor: Michael Mosholder, Powell, Ohio

[73] Assignee: Tokyo Shibaura Denki Kabushiki Kaisha, Japan

[21] Appl. No.: 516,947

[22] Filed: Jul. 25, 1983

[51] Int. Cl.[4] ..... G03G 15/20

[52] U.S. Cl. ..... 355/3 FU; 355/14 FU

[58] Field of Search ..... 355/3 FU, 14 FU; 118/114–117; 100/158 R, 158 C, 176, 262

[56] References Cited

U.S. PATENT DOCUMENTS

| | | | |
|---|---|---|---|
| 4,192,229 | 3/1980 | Tsunoi | 100/158 |
| 4,341,458 | 7/1982 | Glasa | 355/3 |
| 4,343,234 | 8/1982 | Sasaki | 100/158 |
| 4,417,803 | 11/1983 | Kobayashi | 355/3 FU |

*Primary Examiner*—A. T. Grimley
*Assistant Examiner*—C. Romano
*Attorney, Agent, or Firm*—Banner, Birch, McKie & Beckett

[57] ABSTRACT

This invention relates to a compact, lightweight pressure fusing device for permanently fixing electrostatic toner onto a copy sheet. The pressure fusing device of this invention includes a first cylindrical pressure fusing roll and a second cylindrical pressure fusing roll. The pressure fusing rolls are positioned to form a nip therebetween. The pressure fusing rolls are each relatively rotatable about their respective longitudinal axis. Either or both of the rolls may be driven.

Each of the pressure fusing rolls is rotatably fixed within a substantially rigid bearing housing and is rotatable on a bearing within the bearing housing. Both the bearing and bearing housing extend substantially the entire longitudinal length of the pressure fusing roll so that pressure applied to the bearing housing is transmitted uniformly along the roll axis of each pressure fusing roll and the roll is constrained against longitudinal deflection.

18 Claims, 3 Drawing Figures

DEVICE FOR PRESSURE FUSING IMAGES ONTO PAPER IN ELECTROSTATIC COPIERS

BACKGROUND OF THE INVENTION

This invention relates to electrostatic copiers that produce an image by depositing a dry, powdered toner on paper. The invention relates specifically to a device for pressure fusing the toner image to the paper.

In most currently popular business office copying machines, the copying machine forms an optical image of the material to be copied which is projected onto the surface of a sensitized semiconductor, forming an electrostatic image. A dark color, electrostatically sensitive powdered material, called toner, is brought into contact with the sensitized semiconductor. Toner particles adhere to the areas on the semiconductor where an electrostatic charge is present. The toner particles, maintaining the pattern formed on the semiconductor, are then transferred to a sheet of paper. The toner particles are bonded to the paper, forming a permanent reproduction of the material being copied.

Three basic methods have been used to bond the toner to the paper: solvent fusing, thermal fusing, and pressure fusing. In addition, a combination of heat and pressure have been found to be effective also. Solvent fusing is least desirable because personnel can be exposed to harmful solvent vapors. Thermal fusing, or the combination of heat and pressure to fuse the toner, is the most commonly used technique. However, with any thermal based operation, power consumption and warm-up time are significant. Pressure-only fusing has not been used extensively because there have been no good pressure fixable toners that will operate with plain paper at pressures less than 200–300 pounds per linear inch (pli). At these pressures, the size, weight and cost of the pressure applying elements become significant factors in a copying machine.

In most prior art electrostatic copiers that use pressure fusing devices to fix or fuse the toner image to paper, the paper with an unfused image of loosely adhering toner particles is passed between two parallel rolls that are pressed together. Generally, the rolls are supported at their ends on bearings and usually the rolls are of equal diameter. Most often, only one of the rolls is driven, the second roll being an idler roll. Accordingly, the surface velocity of the rolls is the same. In order to achieve essentially uniform fusing pressures along their entire length, the rolls are of relatively large diameter so that their deflection can be low.

SUMMARY OF THE INVENTION

The invention described and claimed herein is directed to a compact, light weight, economical device for pressure fusing electrostatic toners onto plain paper in copying machines. The pressure fusing device of this invention includes a first cylindrical pressure fusing roll and a second cylindrical pressure fusing roll. The pressure fusing rolls are positioned to form a nip therebetween. The pressure fusing rolls are each relatively rotatable about their respective longitudinal axes. Either or both of the rolls may be driven.

Each of the pressure fusing rolls is rotatably fixed within a substantially rigid bearing housing and is rotatable on a bearing within the bearing housing. Both the bearing and bearing housing extend substantially the entire longitudinal length of the pressure fusing roll so that pressure applied to the bearing housing is transmitted uniformly along the roll axis of each pressure fusing roll. The bearing housing is designed to be substantially rigid, both laterally (i.e., in the direction of the paper flow) and vertically. Roller deflection constraint is achieved by the bearing housing rather than by the use of large diameter pressure fusing rolls as in the prior art. Accordingly, the pressure fusing rolls of the instant invention may be of a substantially smaller diameter than those employed in prior art pressure fusing devices. Since the smaller diameter roll will have a correspondingly smaller contact surface area, a smaller pressure fusing force can be used, while still providing the same force per unit area to achieve satisfactory fusing as is obtained with the larger prior art rolls. The bearing housing is relatively light weight and is designed so that it will have essentially the same moment of inertia, and hence, stiffness, as the large diameter heavy pressure fusing rolls of the prior art.

The bearing housing may be made of any configuration which will accommodate the design constraints of a relatively light weight pressure fusing device and which will fit within the spacial constraints of a copying machine. To perform properly, the bearing housing must be adequately stiff, which is dependent upon the cross-sectional shape of the housing and the material chosen for the housing. In addition to adequate stiffness, the housing should be light weight. In a preferred embodiment, the bearing housing includes first and second parallel spaced side walls and spaced top and bottom walls connecting the side walls. The bottom wall is concave and conforms to the cylindrical configuration of the pressure fusing roll. In this configuration, the bearing is fixed to the concave bottom wall of the bearing housing, and the bearing is also concave and conforms to the configuration of the pressure fusing roll. The bearing housing may be hollow, that is, it may include a cavity between the side walls and the top and bottom walls. This type of design helps to reduce the weight of the bearing housing.

Other embodiments of the bearing housing may, of course, also be used according to the invention. For example, the bearing housing may be substantially rectangular and include a bearing receiving opening facing the pressure fusing roll, with the bearing fixed within the bearing receiving opening. Alternatively, the bearing housing means may be substantially shaped as an I-beam in cross-section and also include a bearing receiving opening facing the pressure fusing rolls with a bearing fixed within the bearing receiving opening. In each configuration, however, the bearing housing transmits a uniform pressure to a copy sheet passing through the nip between two pressure fusing rollers.

Fixed within the bearing housing is a bearing element. In a preferred embodiment, the bearing may be an air bearing, a hydraulic fluid bearing, or a self-lubricating bearing material. Other bearing types may also be used.

DESCRIPTION OF THE PREFERRED EMBODIMENTS

Figure 1:
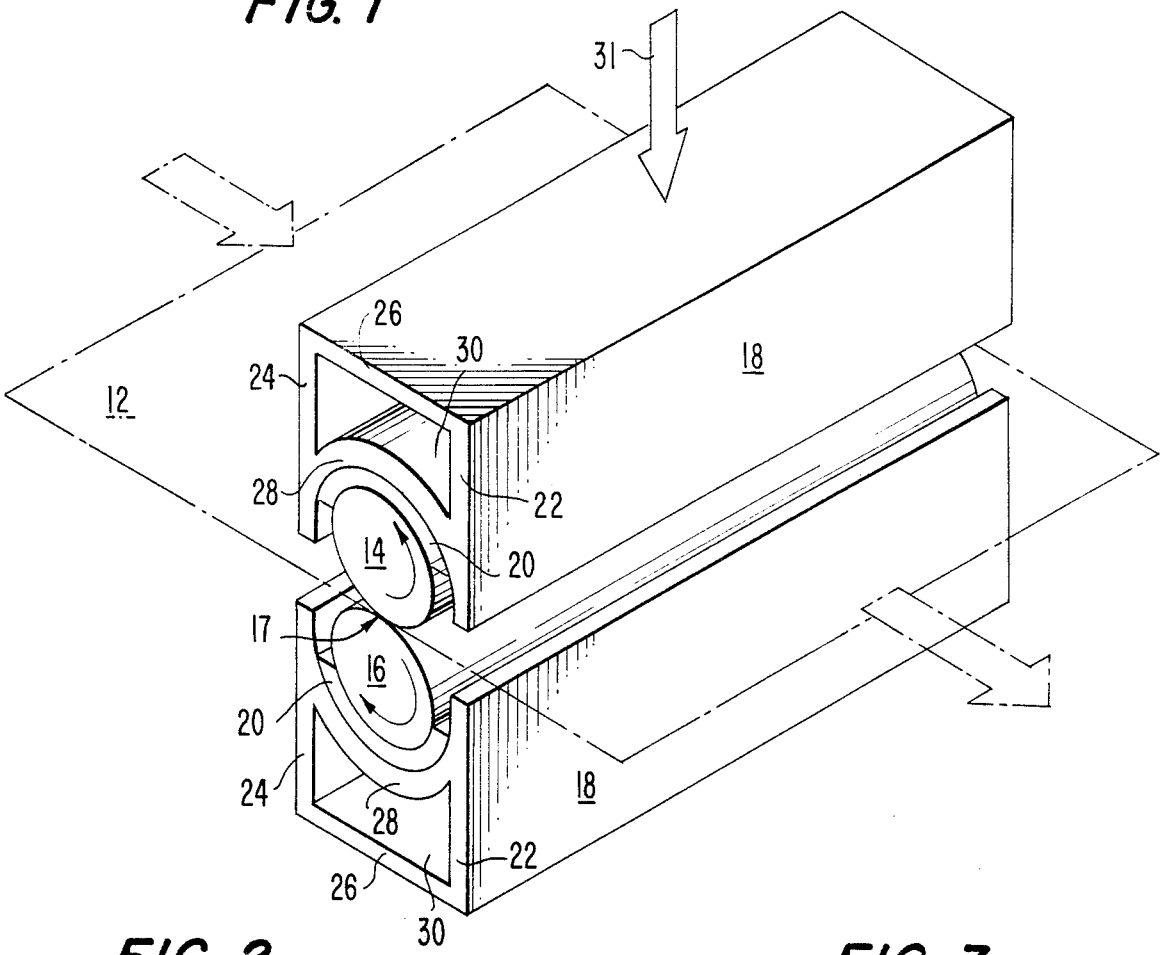
FIG. 1 is a general perspective view of a pressure fixing device according to the invention, also showing a copy sheet being conveyed throught the pressure fixing device.

A pressure fixing device according to one embodiment of the present invention is shown generally at 10. Pressure fixing device 10 is intended to apply a uniform pressure to a copy sheet shown at 12 which is conveyed between rollers 14, 16 of pressure fixing device 10.

Pressure fixing device 10 includes a first cylindrical pressure fusing roller 14 and a second cylindrical pressure fusing roller 16. Pressure fusing rollers 14 and 16 come together to form a nip therebetween shown generally at 17, that is, a region where the rolls are closest together. Pressure fusing rolls 14 and 16 are each relatively rotatable about their respective longitudinal axis. Either or both of the rolls may be driven by any means that are conventional and well-known in the art.

Pressure fusing rolls 14 and 16 are fixed within a bearing housing shown genrally at 18. A bearing 20 is fixed within each bearing housing 18 and forms the bearing surface on which rolls 14 and 16 rotate. In the embodiment illustration in FIG. 1, bearing housing 18 includes first and second parallel, spaced side walls 22, 24 and spaced top and bottom walls 26, 28, respectively. Top wall 26 and bottom wall 28 connect with side walls 22, 24. Bottom wall 28 is concave and conforms to the cylindrical configuration of rolls 14, 16. Bearing 20 is fixed to the concave bottom wall 28 and also is concave in shape so that the bearing surface conforms to the cylindrical configuration of rolls 14, 16.

As shown in FIG. 1, bearing housing 18 may also include a cavity 30 between side walls 22, 24 and top and bottom walls 26, 28, respectively. Cavity 30 helps to make bearing housing 18 light weight, yet does not adversely effect its stiffness.

Figure 2:
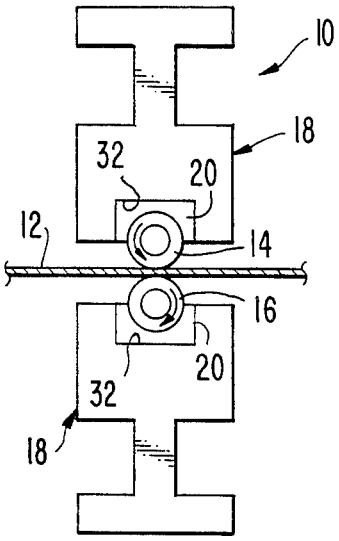
FIG. 2 is a cross-sectional view of a second embodiment of a bearing housing according to the invention.

In the embodiment shown in FIG. 2, bearing housing 18 has a substantially I-shaped cross-section, a bearing receiving opening 32 facing each of rolls 14, 16.

Figure 3:
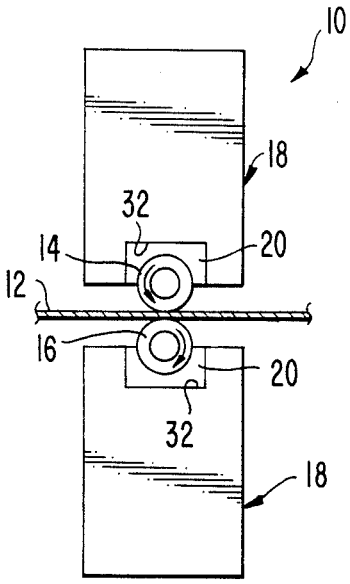
FIG. 3 is a cross-sectional view of a third embodiment of a bearing housing according to the invention.

In the embodiment shown in FIG. 3, bearing housing 18 has a substantially rectangular cross-section. A bearing receiving opening 32 is provided facing rolls 14 and 16. Bearing 20 is fixed within bearing receiving opening 32.

As shown in FIG. 1, both bearing housing 18 and bearing 20 extend substantially the entire longitudinal length of pressure fusing rolls 14 and 16 so that fusing pressure 31 applied to the bearing housing is transmitted uniformly along the roll axis of pressure fusing rolls 14 and 16. Additionally, pressure fusing rolls 14 and 16 are constrained by bearing housing 18 against longitudinal deflection. Deflection of pressue fusing rolls 14 and 16 directly effects the distribution of force over the length of the rolls 14 and 16. If deflection is kept small, the force applied to copy sheet 12 and toner on copy sheet 12 is nearly uniform over the entire length of pressure fusing rolls 14 and 16, resulting in better fusing of the toner to copy sheet 12.

Bearing housing 18 is substantially rigid both laterally and vertically so that it will efficiently transmit force to pressure fusing rolls 14 and 16. The material from which bearing housing 18 is made and the shape of bearing housing 18 are selected to be compatible and complimentary in providing a stiffness, or moment of inertia, which will constrain rolls 14 and 16 against deflection along their roll axis.

Examples of materials that have proven satisfactory for bearing housing 18 include steel, aluminum, and composite materials of resin and woven fiber. Steel has a high modulus of elasticity which serves to limit deflection and also is of relatively low cost. It is, however, somewhat heavier than the other materials. Alluminum is lighter than steel and is only moderately expensive. A third suitable material is a composite material consisting of a resin/woven fiber combination. This composite material provides a high stiffness to weight ratio.

Bearing housing 18 must fit within a specified spacial envelope of a copy machine and still function satisfactorily. That is, bearing housing 18 must prevent the rolls from deflecting excessively so that uniform pressure will be applied to copy sheet 12 as it passes between rolls 14 and 16. As an example of the spacial constraints of a standard copier, the entire pressure fusing device of the present invention must fit within a maximum space that is approximately seven inches wide by approximately seventeen inches long by approximately seven inches deep in order to fit within a copy machine in which this invention is intended to be used.

Bearing 20 may be any bearing type. Preferably, bearing 20 is either an air bearing, a hydraulic fluid bearing or a self-lubricating bearing material. There are many bearing materials with properties suitable for use as bearing 20. These include phenolics, polyimides, Teflon filled pourous bronze, Teflon/fiberglass fabrics, carbon graphite material, lead, bronze, wood and various combinations of these materials. The selection of a material most suitable for a given application depends highly upon the operating conditions under which the bearing must function. Careful consideration of operating conditions, bearing material, and use of additional lubrication can extend the service life of bearing 20.

Housing 18, by preventing deflection of the roll and distributing the pressure force along the entire length of the bearing also ensures that bearings 20 wear uniformly over their entire length.

Although the invention has been described with respect to a particular embodiment, various modifications will be obvious to those of ordinary skill in the art. Accordingly, the invention is defined and limited only by the following claims.

I claim:

1. A pressure fixing device for a copying machine comprising:

a first cylindrical pressure fusing roll and a second cylindrical pressure fusing roll, said pressure fusing rolls positioned to form a nip therebetween and said pressure fusing rolls each relatively rotatable about their respective longitudinal axis;

each of said pressure fusing rolls being rotatably fixed within substantially rigid bearing housing means for transmitting force to and constraining deflection of said pressure fusing rolls, and said pressure fusing rolls being rotatable solely on a bearing within said bearing housing means, said bearing and said bearing housing means extending substantially the entire longitudinal length of said pressure fusing rolls so that pressure applied to said bearing housing means is transmitted uniformly along the roll axis of said pressure fusing rolls and said pressure fusing rolls are constrained against longitudinal deflection.

2. A pressure fixing device as recited in claim 1 wherein said bearing housing means includes first and second parallel, spaced sidewalls, and spaced top and bottom walls connecting said sidewalls, said bottom wall being concave and conforming to the cylindrical configuration of said pressure fusing rolls.

3. A pressure fusing roll as recited in claim 2 wherein said bearing is fixed to said concave bottom wall of said bearing housing means and said bearing is concave and conforms to the cylindrical configuration of said pressure fusing rolls.

4. A pressure fixing device as recited in claim 2 wherein said bearing housing means further includes a cavity between said side walls and said top and bottom walls.

5. A pressure fixing device as recited in claim 1 wherein said bearing housing means comprises a substantially rectangular bearing housing, said bearing housing having a bearing receiving opening facing said pressure fusing rolls, and said bearing is fixed within said bearing receiving opening.

6. A pressure fixing device as recited in claim 1 wherein said bearing housing means comprises a substantially I-shaped cross-section bearing housing, said bearing housing having a bearing receiving opening facing said pressure fusing rolls, and said bearing is fixed within said bearing receiving opening.

7. A pressure fixing device as recited in claim 1 wherein said bearing is a self-lubricating bearing.

8. A pressure fixing device as recited in claim 1 wherein said bearing is an air bearing.

9. A pressure fixing device as recited in claim 1 wherein said bearing is a hydraulic fluid bearing.

10. In a copying machine which includes a photoconductive surface, charging means for imparting a uniform electrostatic charge to the photoconductive surface, exposure and imaging means for exposing the photoconductive charged surface to a light image of an original to be copied and forming on the photoconductive surface an electrostatic latent image of the original, developer means for developing the latent image, transfer means for transferring the developed latent image onto a copy sheet, and pressure fixing means for permanently fixing the latent image on the copy sheet, the improvement wherein said pressure fixing means comprises:

a first cylindrical pressure fusing roll and a second cylindrical pressure fusing roll, said pressure fusing rolls positioned to form a nip therebetween and said pressure fusing rolls each relatively rotatable about their respective longitudinal axis;

each of said pressure fusing rolls being rotatably fixed within substantially rigid bearing housing means for transmitting force to and constraining deflection of said pressure fusing rolls, and said pressure fusing rolls being rotatable solely on a bearing within said bearing housing means, said bearing and said bearing housing means extending substantially the entire longitudinal length of said pressure fusing rolls so that pressure applied to said bearing housing means is transmitted uniformly along the roll axis of said pressure fusing rolls and said pressure fusing rolls are constrained against longitudinal deflection.

11. An improved pressure fixing means for a copying machine as recited in claim 10 wherein said bearing housing means includes first and second parallel, spaced sidewalls, and spaced top and bottom walls connecting said sidewalls, said bottom wall being concave and conforming to the cylindrical configuration of said pressure fusing rolls.

12. An improved pressure fixing means for a copying machine as recited in claim 10 wherein said bearing is fixed to said concave bottom wall of said bearing housing means and said bearing is concave and conforms to the cylindrical configuration of said pressure fusing rolls.

13. An improved pressure fixing means for a copying machine as recited in claim 10 wherein said bearing housing means further includes a cavity between said side walls and said top and bottom walls.

14. An improved pressure fixing means for a copying machine as recited in claim 10 wherein said bearing housing means comprises a substantially rectangular bearing housing, said bearing housing having a bearing receiving opening facing said pressure fusing rolls, and said bearing is fixed within said bearing receiving opening.

15. An improved pressure fixing means for a copying machine as recited in claim 10 wherein said bearing housing means comprises a substantially I-shaped cross-section bearing housing, said bearing housing having a bearing receiving opening facing said pressure fusing rolls, and said bearing is fixed within said bearing receiving opening.

16. An improved pressure fixing means for a copying machine as recited in claim 10 wherein said bearing is a self-lubricating bearing.

17. An improved pressure fixing means for a copying machine as recited in claim 10 wherein said bearing is an air bearing.

18. An improved pressure fixing means for a copying machine as recited in claim 10 wherein said bearing is a hydraulic fluid bearing.

* * * * *